US008633651B2

(12) United States Patent
Ruether et al.

(10) Patent No.: US 8,633,651 B2
(45) Date of Patent: Jan. 21, 2014

(54) ILLUMINATION ASSEMBLY

(75) Inventors: Holger Ruether, Paderborn (DE); Dirk Beiner, Paderborn (DE)

(73) Assignee: Traxon Technologies Europe GmbH, Paderborn (DE)

( * ) Notice: Subject to any disclaimer, the term of this patent is extended or adjusted under 35 U.S.C. 154(b) by 76 days.

(21) Appl. No.: 13/148,247

(22) PCT Filed: Feb. 2, 2010

(86) PCT No.: PCT/DE2010/000114
§ 371 (c)(1),
(2), (4) Date: Nov. 23, 2011

(87) PCT Pub. No.: WO2010/088886
PCT Pub. Date: Aug. 12, 2010

(65) Prior Publication Data

US 2012/0062139 A1 Mar. 15, 2012

(30) Foreign Application Priority Data

Feb. 5, 2009 (DE) ..... 10 2009 007 503

(51) Int. Cl.
*H05B 37/00* (2006.01)

(52) U.S. Cl.
USPC ..... 315/200 R; 315/312; 315/291; 315/112

(58) Field of Classification Search
USPC ..... 315/152, 200 R, 312, 291, 307, 209 R, 315/86
See application file for complete search history.

(56) References Cited

U.S. PATENT DOCUMENTS

| | | | | |
|---|---|---|---|---|
| 6,498,440 | B2 * | 12/2002 | Stam et al. | 315/291 |
| 7,140,752 | B2 * | 11/2006 | Ashdown | 362/276 |
| 7,649,327 | B2 * | 1/2010 | Peng | 315/312 |
| 7,687,753 | B2 * | 3/2010 | Ashdown | 250/205 |
| 2004/0240890 | A1 | 12/2004 | Lys et al. | |
| 2006/0251110 | A1 | 11/2006 | Binder | |
| 2007/0182338 | A1 * | 8/2007 | Shteynberg et al. | 315/200 R |
| 2007/0267984 | A1 | 11/2007 | Peng | |
| 2009/0021182 | A1 * | 1/2009 | Sauerlaender | 315/291 |
| 2009/0243510 | A1 | 10/2009 | Pauritsch et al. | |
| 2010/0315007 | A1 * | 12/2010 | Schulz et al. | 315/152 |

FOREIGN PATENT DOCUMENTS

| | | |
|---|---|---|
| DE | 10 2004 002 026 | 8/2005 |
| DE | 10 2006 001 868 | 7/2007 |
| DE | 10 2006 028 074 | 12/2007 |
| JP | 2004-215324 | 7/2004 |
| JP | 2005207679 | 8/2005 |
| WO | WO 94/23366 | 10/1994 |
| WO | WO 03/065201 | 8/2003 |
| WO | WO 2007/090292 | 8/2007 |
| WO | WO 2008/001274 | 1/2008 |
| WO | WO 2008/050294 | 5/2008 |
| WO | WO 2009/133489 | 11/2009 |

* cited by examiner

*Primary Examiner* — Vibol Tan
(74) *Attorney, Agent, or Firm* — Cozen O'Connor

(57) ABSTRACT

An illumination assembly, comprising: at least one luminous means having at least one luminescence diode chip as light source, and at least one energizing means, which is connected to the at least one luminous means via a connecting line, wherein the energizing means is designed to energize the at least one luminous means. The energizing means comprises at least one filter element designed to filter signals which enter into the energizing means from a power supply for the energizing means and exit from the energizing means into the power supply.

20 Claims, 3 Drawing Sheets

ILLUMINATION ASSEMBLY

RELATED APPLICATIONS

This application is a U.S. National Phase Application under 35 USC 371 of International Application No. PCT/DE2010/000114 filed on Feb. 2, 2010.

This patent application claims the priority of German patent application 10 2009 007 503.8 filed Feb. 5, 2009, the disclosure content of which is hereby incorporated by reference.

FIELD OF THE INVENTION

The present invention is related to an illumination assembly having at least one luminescence diode chip.

SUMMARY OF THE INVENTION

In accordance with at least one embodiment of the illumination assembly, the illumination assembly comprises at least one luminous means. The luminous means is, for example, an emitter, a lamp, a light-emitting diode module, a lantern or the like. The luminous means preferably comprises at least one luminescence diode chip. The luminescence diode chip is, for example, a light-emitting diode chip or a laser diode chip.

During the operation of the luminous means, the luminescence diode chip emits electromagnetic radiation, for example in the visible wavelength range, that is to say light. The at least one luminescence diode chip is preferably a light source of the luminous means. That is to say that the at least one luminescence diode chip generates, during operation, at least part of the light that is emitted by the luminous means.

In accordance with at least one embodiment of the illumination assembly, the illumination assembly comprises at least one energizing means. The energizing means is designed to energize the luminous means of the illumination assembly. All luminous means of the illumination assembly are energized by the energizing means. That is to say that the luminous means of the illumination assembly are supplied with electric current and operated in this way by the energizing means. For this purpose, the luminous means are connected to the energizing means via a connecting line. In this case, it is also possible for different luminous means to be connected to one and the same energizing means via different connecting lines, or for a plurality of luminous means to be connected to the energizing means by one and the same connecting line.

In accordance with at least one embodiment of the illumination assembly, the energizing means comprises at least one filter element. The filter element is designed to filter the signal which enters into the energizing means from a power supply for the energizing means and exits from the energizing means into the power supply. The power supply is, for example, a connection of the energizing means to the public electricity grid. Therefore, AC current is passed into the energizing means by means of the power supply.

The filter element then filters signals which pass into the energizing means from the power supply. Said signals can be interference, for example, which can be superposed for example on the AC voltage from the power supply. Furthermore, the filter element filters signals which exit from the energizing means into the power supply. These outgoing signals can be, for example, signals which were impressed on the connecting line by means of the energizing means and/or which originate from the luminous means of the illumination assembly.

In accordance with at least one embodiment of the illumination assembly, the illumination assembly comprises at least one luminous means, wherein the luminous means comprises at least one luminescence diode chip as light source. Furthermore, the illumination assembly comprises at least one energizing means, which is connected to the at least one luminous means via a connecting line. The energizing means is designed to energize the at least one luminous means, and the energizing means comprises at least one filter element designed to filter the signal which enters into the energizing means from a power supply for the energizing means and exits from the energizing means into the power supply.

In accordance with at least one embodiment of the illumination assembly, the energizing means is designed to impress signals on the connecting line. The signals code data which pass from the energizing means to the luminous means via the connecting line. The connecting line thus performs a double function: it serves firstly for current transport and secondly for data transfer.

In other words, not only is the electric current for operating the luminous means transported from the energizing means via the connecting line, but the energizing means impresses signals on the connecting line which pass to the luminous means via the connecting line. The luminous means are energized and driven, in particular, by means of a so-called carrier frequency system (powerline communication).

The data impressed as signals on the connecting line are impressed into the energizing means via a signal line, for example.

When using luminous means comprising at least one luminescence diode chip as light source, it proves to be advantageous that a desired color locus and/or a desired brightness of the light emitted by the luminous means during operation can be set by means of a targeted energization of the light-emitting diode chips of the luminous means. For such driving of the luminous means, control signals can be impressed into the luminous means, which are processed in the luminous means. In accordance with the signals, the luminescence diode chips of the luminous means are then operated such that light of the desired color locus and/or of the desired brightness is emitted by the luminous means.

The illumination assembly is firstly based on the concept, then, of impressing the signals on those connecting lines via which the luminous means are also supplied with electric current. In other words, the control signals and also the operating current are transported from the energizing means to the luminous means via one and the same connecting line. This proves to be particularly economic since the number of connecting lines between energizing means and luminous means can be reduced in this way. In this way, the illumination assembly can comprise two or more luminous means which are supplied with electric current and control signals by a single energizing means.

Furthermore, it has been found that the transmission of electric current and signals via the same connecting line allows a particularly free interconnection of a plurality of luminous means of the same illumination assembly. The luminous means are in this case energized and driven by means of a so-called carrier frequency system (powerline communication). It is therefore not necessary—in contrast to conventional solutions—to connect the luminous means in star fashion to a driving device from which precisely one connecting line leads to each luminous means, rather two or more luminous means can also be interconnected in series with one another via the connecting line and are nevertheless individually drivable by the energizing means and the signals impressed on the connecting line. The luminous means can be interconnected for example in a "daisy chain" or even in free topology.

The illumination assembly is furthermore based on the concept that the filter element in the energizing means filters the signals with which the luminous means are controlled prior to the exit into the power supply for the energizing means. In this way, it is ensured that the signals for example do not disturb adjacent illumination assemblies and lead to faulty operation there. Furthermore, the filter element also filters incoming interference signals upon entry into the energizing means. Overall, the luminous means form a subnetwork which is shielded from the power supply, that is to say for example from the public electricity grid, by the energizing means.

In accordance with at least one embodiment of the illumination assembly, the filter element comprises at least one low-pass filter. In other words, the filter element comprises a filter which transmits signal components having frequencies below a predeterminable limit frequency approximately in an unattenuated manner. By contrast, components having higher frequencies are attenuated or cannot pass through the filter at all. The components having higher frequencies are preferably signals which were impressed as control signals on the connecting line by the energizing means, or interference signals which are fed into the energizing means from the power supply and can be incorrectly interpreted as control signals in the illumination assembly. In this case, by way of example, the filter element can comprise precisely one low-pass filter or else two low-pass filters, wherein one low-pass filter filters incoming signals and the other low-pass filter filters outgoing signals.

In accordance with at least one embodiment of the illumination assembly, the signals impressed on the connecting line by the energizing means are provided for controlling the at least one luminous means. Preferably, the signals are provided for controlling at least two or a multiplicity of luminous means. That is to say that the at least one luminous means is driven by means of the signals. The luminous means itself can have a drive device suitable for decoding the signals, such that the luminescence diode chips of the luminous means are operated by the drive device in accordance with the decoded signals.

In accordance with at least one embodiment of the illumination assembly, the signals impressed on the connecting line by the energizing means are provided for setting the brightness and/or the color locus of the at least one luminous means. By way of example, the brightness of each luminescence diode chip of the luminous means can be set by means of the signals. if the luminous means comprises a plurality of luminescence diode chips which emit light of different colors, the color locus of the light generated by the luminous means can also be set in this way. In this case, it is also possible for the illumination assembly to comprise two or more luminous means which are driven individually by the signals.

In accordance with at least one embodiment of the illumination assembly, the energizing means comprises at least one modulator for impressing the signals on the connecting line. That is to say that the electric current with which the luminous means are operated is superposed with a control signal with the aid of the modulator. By means of the control signal, the luminous means of the illumination assembly are then operated in the manner described.

In accordance with at least one embodiment of the illumination assembly, the at least one luminous means comprises at least one sensor which determines an operating state of the at least one luminescence diode chip of the luminous means. In this case, it is possible for the luminous means to comprise for each luminescence diode chip at least one sensor which individually detects the operating state of said luminescence diode chip. However, it is also possible for all the luminescence diode chips of the luminous means to be assigned exactly a single sensor that detects the averaged operating state of all the luminescence diode chips of the luminous means.

In accordance with at least one embodiment of the illumination assembly, signals corresponding to the operating state are communicated to the energizing means via the connecting line. For this purpose, the luminous means comprises a drive device, for example, which can comprise a modulator. By means of the drive device, signals in which the operating state determined by the sensor is coded are impressed on the connecting line and communicated to the energizing means by the connecting line. That is to say that, in this embodiment, not only are control signals sent from the energizing means to the luminous means, but the luminous means themselves send back signals that allow a conclusion to be drawn about the operating state of, for example, the luminescence diode chips of the luminous means. By means of corresponding processing of these signals it is possible to provide a control loop for operating the luminous means. Thus, in the case of an excessively high operating temperature of the luminescence diode chips, for example, the brightness of the luminescence diode chips and hence the waste heat generated during operation can be reduced.

In accordance with at least one embodiment of the illumination assembly, the energizing means comprises at least one demodulator designed for recovering the signals corresponding to the operating state. That is to say that the signals corresponding to an operating state which were impressed on the connecting line by the luminous means can be recovered by a demodulator in the energizing means. In this case, it is possible for modulator and demodulator to be combined and integrated in a single element.

In accordance with at least one embodiment of the illumination assembly, the signals corresponding to the operating state can be read out at the energizing means. That is to say that the energizing means has a data output, at which the signals which were impressed on the connecting line by the luminous means can be read out. The signals can be fed from there to a computer system, for example, which, depending on the operating state of the luminous means, can feed control signals to the luminous means via the energizing means and the connecting line.

In accordance with at least one embodiment of the illumination assembly, the operating state determined by the at least one sensor comprises at least one of the following measurement variables for the at least one luminescence diode chip of the at least one luminous means: operating duration, operating temperature, brightness. That is to say that the sensor or sensors of a luminous means is or are suitable for determining the operating duration, the operating temperature and/or the brightness of all the luminescence diodes of the luminous means or of individual luminescence diodes of the luminous means. In this way, information about the operating duration, the operating temperature and/or the brightness of the luminescence diode chips can be forwarded to the energizing means.

BRIEF DESCRIPTION OF THE DRAWINGS

The illumination assembly described here is explained in greater detail below on the basis of exemplary embodiments and with reference to the associated figures.

DETAILED DESCRIPTION OF THE DRAWINGS

Elements which are identical, of identical type or act identically are provided with the same reference symbols in the figures. The figures and the size relationships of the elements illustrated in the figures among one another should not be regarded as to scale. Rather, individual elements may be illustrated with an exaggerated size in order to enable better illustration and/or in order to afford a better understanding.

Figure 1:
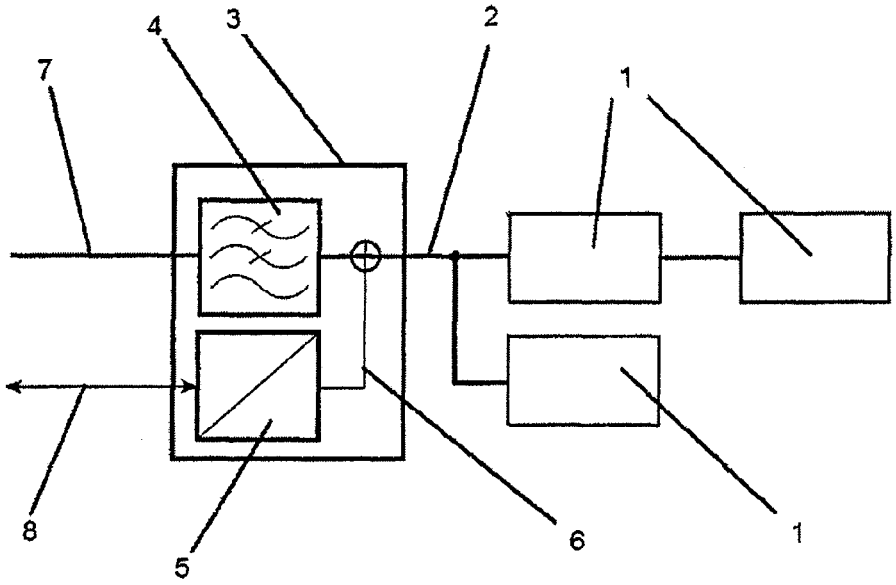
FIG. 1 shows, on the basis of a schematic circuit diagram, a first exemplary embodiment of an illumination assembly described here.

FIG. 1 shows, on the basis of a schematic circuit diagram, a first exemplary embodiment of an illumination assembly described here. In the present case, the illumination assembly comprises three luminous means. The illumination assembly can comprise up to 16 luminous means, for example, which are connected to a single energizing means 3 via connecting lines 2. An exemplary embodiment of a luminous means 1 is explained in greater detail by way of example in conjunction with FIG. 2.

The luminous means 1 can be arranged downstream of the energizing means 3 with free topology. By way of example, they are connected to one another in the sense of a "daisy chain". Furthermore, it is also possible, for example, for the luminous means to be connected to one another in other types of connection such as a spur line or star cabling. Furthermore, mixtures of the aforementioned types of cabling are also conceivable. At least two of the luminous means 1, in the extreme case all the luminous means, of the illumination assembly can be connected in series with one another.

Alongside the luminous means 1, the illumination assembly comprises the energizing means 3. By means of the energizing means 3, the luminous means 1 are supplied with the electric current required for their operation. Furthermore, the energizing means 3 transmits control signals for operating the luminous means to the latter. The energizing means 3 is connected to the luminous means 1 via the connecting line 2.

In the present case, the energizing means 3 comprises a filter element 4 which is formed by a low-pass filter and is connected to the luminous means 1 via the connecting line 2. Furthermore, the energizing means 3 comprises a modulator/demodulator 5, which is connected to the connecting line 2 via a coupling element 6. The energizing means 3 is connected to the power supply 7, by means of which, for example, AC current conventional in the grid system is fed into the energizing means 3.

Furthermore, the energizing means 3 is connected to a signal line 8, via which data in the form of signals can be coupled out from the energizing means 3 and/or coupled into the energizing means 3. The signal line 8 is connected for example to a computer (not shown) on which a program for controlling the luminous means 1 is executed.

The illumination assembly is operated as follows, for example: via the power supply 7, electric current is impressed into the energizing means 3. Interfering signals are filtered out of the electric current by means of the filter element 4. The interfering signals are, for example, control signals of adjacent illumination assemblies or interference signals which are present in the electricity grid and which can be superposed on the control signals.

Furthermore, the energizing means 3 is connected to the signal line 8 via which signals are impressed into the energizing means 3. The signals are impressed on the connecting line 2 by means of the modulator/demodulator 5. The connecting line 2 therefore carries both the electric current for operating the luminous means 1 and signals for controlling the luminous means 1. By way of example, AC current on which control signals for driving the luminous means 1 are modulated can be communicated to the luminous means 1 via the connecting line 2.

The luminous means 1 form, downstream of the energizing means 3, a subnetwork that is terminated by the power supply 7 and hence the public electricity grid, for example. That is to say that signals in the subnetwork of the luminous means 1 do not pass to the power supply and signals from the power supply do not pass to the luminous means 1.

The luminous means 1 are interconnected with one another in the subnetwork downstream of the energizing means 3.

Figure 2:
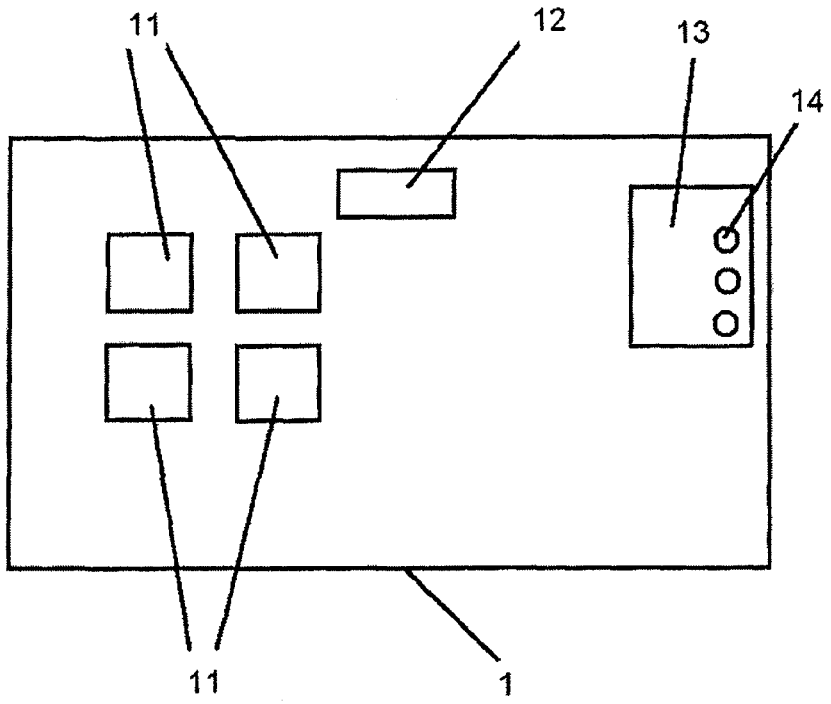
FIG. 2 shows, on the basis of a schematic plan view, a luminous means such as can be used in one exemplary embodiment of an illumination assembly described here.

The luminous means are explained in greater detail in conjunction with FIG. 2:

The luminous means 1 comprise sensors 12, for example, the measured values of which are converted to signals by a drive device 13.

The luminous means 1 comprise a luminescence diode chip 11, preferably a multiplicity of luminescence diode chips 11, which can be formed for example by light-emitting diode chips. By way of example, a luminous means comprises at least one luminescence diode chip 11 that emits red light, at least one luminescence diode chip 11 that emits blue light, and at least one luminescence diode chip 11 that emits green light. Furthermore, it is possible for the luminous means 1 to comprise at least one white, at least one warm-white, at least one cold-white and/or at least one dynamically white light-emitting diode chip.

The luminous means 1 furthermore comprises at least one sensor 12 which determines an operating state of the luminescence diode chips 11. By way of example, the sensor 12 is an operating duration counter, a temperature sensor or a photodiode. By way of example, measured values such as the operating duration of the luminescence diode chips 11, the operating temperature of the luminescence diode chips 11 or the brightness of the luminescence diode chips 11 can be determined by means of the sensor.

The sensor 12 is connected to a drive device 13, which comprises a modulator, for example, which impresses signals on the connecting line 2 in accordance with the measured values of the sensor 12. The luminous means 1 furthermore comprises connection locations 14, via which signals can pass from the luminous means 1 and into the luminous means 1. Furthermore, the electric current for operating the luminous means 1 can be impressed into the latter via the connection locations 14.

For incoming signals for controlling the luminous means 1, the drive device 13 comprises a demodulator that recovers the signals. The drive device then energizes the luminescence diode chips 11 in accordance with the transmitted control signals.

The measured values determined by the sensor 12 are communicated on the basis of signals via the connecting line 2 to the energizing means 3, where they are recovered with the aid of the modulator/demodulator 5. The recovered data can be read out via the signal line 8 at the energizing means 3 and are communicated from there for example to a computer (not shown) which can calculate control signals for driving the luminous means 1 on the basis of the signals read out. By way of example, in the case of an excessively high operating temperature of the luminescence diode chips 11, the brightness thereof can be reduced. This increases the lifetime of the luminescence diode chips 11.

By means of the filter element 4, the signals are filtered before exiting from the energizing means 3 into the power supply 7, with the result that no interference with the public electricity grid, for example, takes place.

Figure 3:
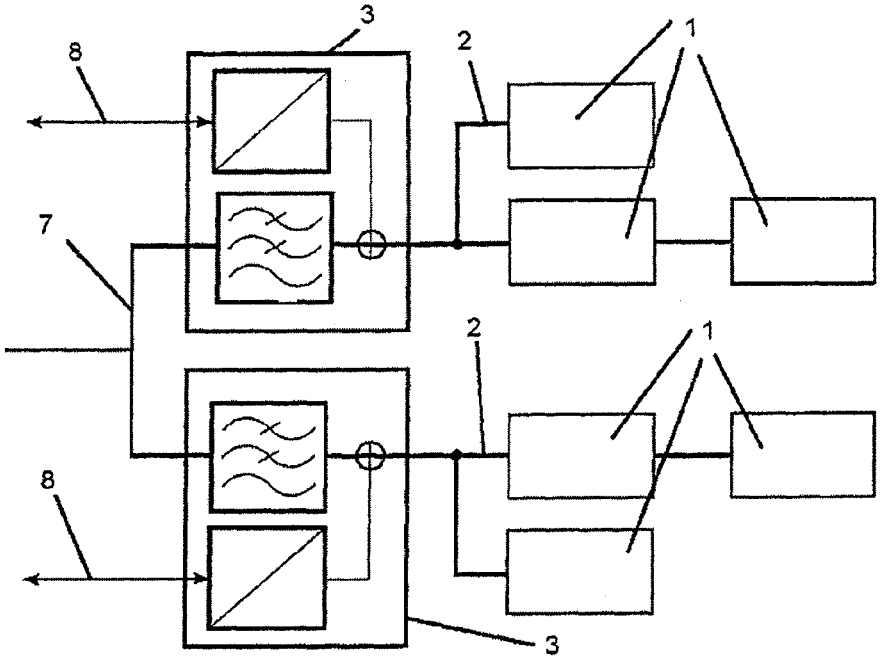
FIG. 3 shows, on the basis of a schematic circuit diagram, exemplary embodiments of two illumination assemblies described here, which are connected to a common power supply.

The interconnection of two illumination assemblies described here is shown with reference to FIG. 3. The illumination assemblies are illumination assemblies as described in conjunction with FIG. 1. Both illumination assemblies are connected to the same power supply 7, for example the public electricity grid. On account of the filter element 4 in the energizing means 3 of the illumination assemblies, control signals and signals of the luminous means 1 are shielded from the power supply 7. Therefore, the illumination assemblies can advantageously be operated from the same power supply, without mutually adversely influencing one another.

In other words, the energizing means 3 decouples the subnetwork of the luminous means 1 from the power supply 7 and enables data exchange between the luminous means 1 and, for example, a computer to which the illumination assembly is connected. In this case, the two energizing means 3 can be connected to the same computer by means of the signal lines 8.

In this case, it is possible for the illumination assemblies to be directly connected to the power supply 7 and to be directly connected to one another via the power supply 7. In this case, "directly" means that no further filter elements for filtering control signals from the illumination assemblies are arranged between the illumination assemblies and/or between an illumination assembly and the power supply 7. In particular, it is possible for no additional electrical or electronic components to be arranged between the illumination assemblies and/or between an illumination assembly and the power supply 7.

The invention is not restricted to the exemplary embodiments by the description on the basis of said exemplary embodiments. Rather, the invention encompasses any novel feature and also any combination of features, which in particular includes any combination of features in the patent claims, even if this feature or this combination itself is not explicitly specified in the patent claims or exemplary embodiments.

The invention claimed is:

1. An illumination assembly, comprising:

at least one luminous means having at least one luminescence diode chip as light source; and at least one energizing means connected to the at least one luminous means via a connecting line;

wherein the at least one energizing means is configured to energize the at least one luminous means;

wherein the at least one energizing means comprises at least one filter element configured to filter signals which enter into the at least one energizing means from a power supply for the at least one energizing means and exit from the at least one energizing means into the power supply;

wherein the signals are control signals by which the at least one luminescence diode chip of the at least one luminous means is operable; and wherein the connecting line carries an electrical current for energizing the at least one luminous means and carries the control signals for controlling the at least one luminous means.

2. The illumination assembly according to claim 1, wherein the filter element comprises at least one low-pass filter.

3. The illumination assembly according to claim 2, wherein the at least one energizing means is configured to impress the signals on the connecting line.

4. The illumination assembly according to claim 3, wherein the signals impressed on the connecting line by the at least one energizing means are provided for controlling the at least one luminous means.

5. The illumination assembly according to claim 1, wherein the signals impressed on the connecting line by the at least one energizing means are provided for setting at least one of a brightness and a color locus of the at least one luminous means.

6. The illumination assembly according to claim 1, wherein the at least one energizing means comprises at least one modulator for impressing the signals on the connecting line.

7. The illumination assembly according to claim 1, wherein the at least one luminous means comprises at least one sensor which determines an operating state of the at least one luminescence diode chip of the at least one luminous means, and wherein signals corresponding to the operating state are communicated to the at least one energizing means via the connecting line.

8. The illumination assembly according to claim 1, wherein the at least one energizing means comprises at least one demodulator for recovering the signals corresponding to an operating state.

9. The illumination assembly according to claim 8, wherein the signals corresponding to the operating state can be read out at the at least one energizing means.

10. The illumination assembly according to claim 7, wherein the operating state comprises at least one measurement variable for the at least one luminescence diode chip of the at least one luminous means comprising operating duration, operating temperature or brightness of emitted light.

11. The illumination assembly according to claim 1, wherein at least two luminous means are connected in series with the connecting line.

12. The illumination assembly according to claim 1, wherein at least one of the luminous means comprises at least two luminescence diode chip which emit light of mutually different colors during operation.

13. The illumination assembly according to claim 11, wherein the at least two luminous means form a subnetwork that is shielded from the power supply by the at least one energizing means.

14. An assembly of illumination assemblies comprising at least two illumination assemblies according to claim 1, wherein the illumination assemblies are connected to the same power supply.

15. The assembly according to claim 14, wherein the at least two illumination assemblies are connected directly to the power supply and are connected directly to one another by the power supply.

16. An illumination assembly, comprising:

at least one luminous means having at least one luminescence diode chip as light source; and at least one energizing means connected to the at least one luminous means via a connecting line, wherein the at least one energizing means is configured to energize the at least one luminous means;

wherein the at least one energizing means comprises at least one filter element configured to filter signals which enter into the at least one energizing means from a power supply for the at least one energizing means and exit from the at least one energizing means into the power supply;

wherein the signals are control signals, by which the at least one luminescence diode chip of the at least one luminous means is operable, such that at least one of light of a desired color locus and light of a desired brightness is emitted by the at least one luminous means; and wherein the signals are impressed into the at least one energizing means via a signal line.

17. The illumination assembly according to claim 1, wherein the signals are impressed into the at least one luminous means and the signals are processed in the at least one luminous means.

18. The illumination assembly according to claim 16, wherein the signals are impressed into the at least one luminous means and the signals are processed in the at least one luminous means.

19. The illumination assembly according to claim 17, wherein the at least one luminous means comprises a drive device comprising a demodulator which recovers the signals.

20. The illumination assembly according to claim 18, wherein the at least one luminous means comprises a drive device comprising a demodulator which recovers the signals.

* * * * *